US005879274A

United States Patent [19]

Mattox

[11] Patent Number: 5,879,274

[45] Date of Patent: Mar. 9, 1999

[54] DUMBBELL ASSEMBLY

[76] Inventor: E. Michael Mattox, 18509 E. Sixth St. North, Independence, Mo. 64056

[21] Appl. No.: 889,286

[22] Filed: Jul. 8, 1997

Related U.S. Application Data

[60] Provisional application No. 60/021,386 Jul. 9, 1996.

[51] Int. Cl. [6] ..... A63B 21/075

[52] U.S. Cl. ..... 482/107; 482/93; 482/108

[58] Field of Search ..... 482/93, 106–109; D21/196–197, 680–682

[56] References Cited

U.S. PATENT DOCUMENTS

| | | | |
|---|---|---|---|
| 850,964 | 4/1907 | Pelletier et al. | 482/108 |
| 3,488,051 | 1/1970 | Papistas-Scherer | 482/108 |
| 4,822,034 | 4/1989 | Shields . | |
| 5,123,885 | 6/1992 | Shields . | |

FOREIGN PATENT DOCUMENTS

| | | | |
|---|---|---|---|
| 1602557 | 10/1990 | U.S.S.R. | 482/108 |

*Primary Examiner*—John Mulcahy
*Attorney, Agent, or Firm*—Rader, Fishman, Grauer & Mc Garry

[57] ABSTRACT

A dumbbell assembly (10) includes a pair of receptacles (12, 14, 60, 82) which are containers adapted to receive and secure weighted plates (28). The receptacles (12, 14, 60, 82) are integrally molded or rigidly secured to opposite ends of a handle bar (18, 88). In one embodiment, the handle bar (18) includes a tube (24) housing at least one spring (16) and a pair of shafts. The spring (16) biases a push platter (46) away from the tube (24) and toward an outer end (36) of the receptacle (12). The weighted plates (28) are admitted into the receptacles through apertures in sidewalls thereof and retained between the spring-biased push platter (46) and the outer end 36 of the receptacle 12. In another embodiment, each end of a handle bar (88) is integrally molded or rigidly secured to a receptacle (82), which is a grooved solid shell with mated first and second portions (90, 92). The first and second portions 90 and 92 are separable, for receiving the weighted plates (28), and mated, for securing weighted plates (28) therein. Both the first and second portions (90, 92) of the receptacle (82) include a series of grooves (100) on an outer wall (102) for seating an elastomeric ring-shaped band (104). Both the first and second portions (90, 92) include a series of ribs (99) defining spaces (96) formed on an inner wall (98) which position the plates (28). The mated portions (90, 92) of the receptacle (82), and the weighted plates (28) within, are secured when an elastomeric band (104) is seated in one of the grooves (100) in the outer wall (102) of each receptacle (82).

17 Claims, 3 Drawing Sheets

DUMBBELL ASSEMBLY

This application claims the benefit of U.S. Provisional application Ser. No. 60/021,386, filed Jul. 9, 1996.

BACKGROUND OF THE INVENTION

1. Field of the Invention

This invention relates to a dumbbell assembly and, more particularly, to a dumbbell assembly with removable weights.

2. Description of the Related Art

Dumbbell assemblies are used by people to build body muscle through exercise consisting of repetitious movement of weight. A typical dumbbell assembly includes plates constituting the weight to be lifted; a handle bar, which is a shaft supporting the plates, and a locking means, which secures the plates to the handle bar by preventing the plates from sliding off the end of the shaft. The current method of securing the plates to the shaft consists of a lock collar, which, after sliding the plates onto the shaft, is also slid onto the shaft. After locking the collar in place, the plates are retained on the end of the shaft and the assembly can be safely lifted. The changing of plates is somewhat time consuming.

SUMMARY OF THE INVENTION

According to the invention, a weight lifting device comprises a handle having receptacles mounted to the ends thereof and adapted to receive one or more disc-shaped weights. A guide is mounted to each handle and mounts a compression spring. The compression spring is adapted to bias at least one weight into an end on each of the receptacles.

In one embodiment, the receptacles are formed as a wire cage with an opening for receiving one of the weights. The handle can be hollow and forms the guide. Further, a pressure plate can be mounted in each receptacle in abutting relationship to the spring. The pressure plates are adapted to abut a weight in a respective receptacle to bias the weight to an outer end of the receptacle. In a preferred embodiment, a shaft is mounted within one of the ends of the spring and is connected to one of the pressure plates to support the one pressure plate. Preferably, a shaft is connected to each pressure plate and mounted in one of the ends of the spring. Preferably, there is a single spring which extends between each of the receptacles. In an alternate embodiment, there are two springs, one mounted at each end of the handle to bias the weights into the ends of the receptacles.

In a further embodiment, a positioning tab is mounted centrally in an end of the receptacle distal from the handle for releasably retaining a disc-shaped weight with a central aperture therein against the pressure from the spring. The positioning tab preferably has a ramped outer surface to guide the weight into the receptacle. The receptacle preferably has an opening at an outer end of the receptacle in register with the positioning tab.

Further according to the invention, a weight lifting device selectively retains weights for repetitive lifting and comprises a handle with receptacles mounted at the ends of the handles adapted to receive and selectively retain one or more disc-shaped weights. In one embodiment, each of the receptacles comprises first and second housing portions which are removably joined together to load and unload weights to and from the handles. Each of the receptacles preferably has grooves to maintain the weights in a predetermined position in the receptacles. The first and second housing portions can be maintained in joined relationship with elastic bands which fit within the grooves.

Still further according to the invention, a weight lifting device for selectively retaining weights for repetitive lifting comprises a handle with receptacles mounted to the ends of the handle and adapted to receive one or more disc-shaped weights. A pressure plate is mounted in each receptacle and mounts a compression spring. Each compression spring is arranged and adapted to bias the at least one weight in each of the receptacles towards an end thereof. The invention further contemplates a plurality of disc-shaped or other relatively flat weights, one or more of which are adapted to be received in the receptacles. The weights can be positioned in the receptacles as selected by the user to change the weight of the weight lifting device.

BRIEF DESCRIPTION OF THE DRAWINGS

The invention will now be described with reference to the drawings in which.

DETAILED DESCRIPTION OF THE PREFERRED EMBODIMENTS

Figure 1:
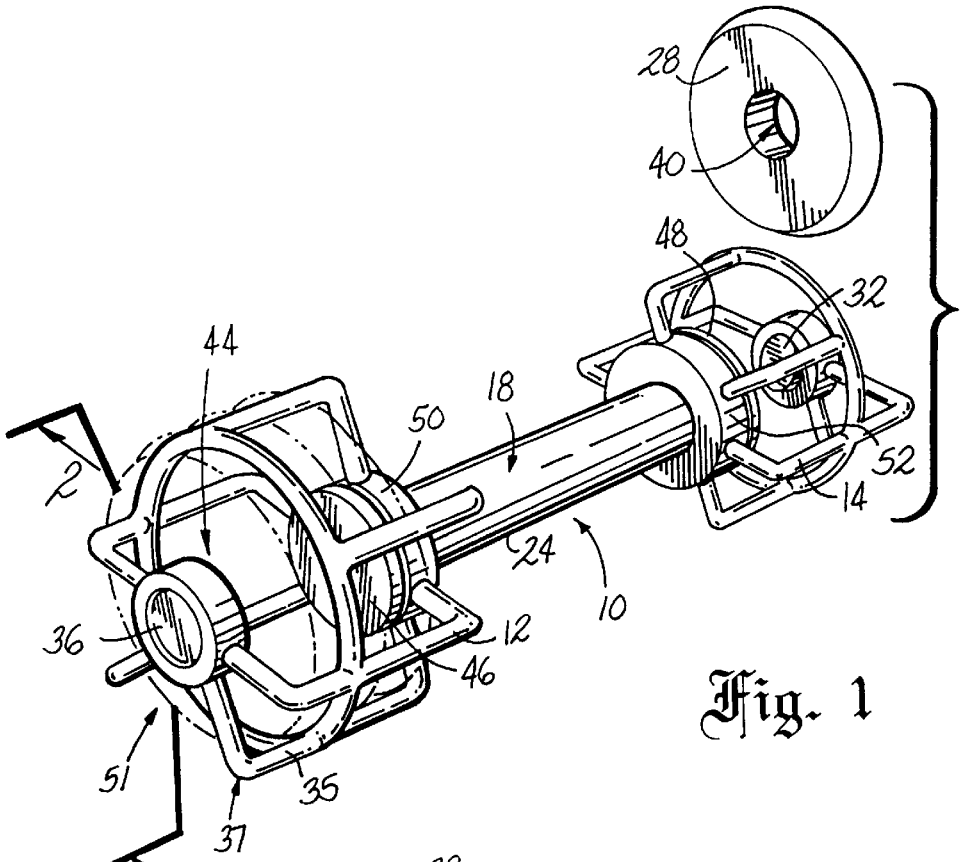
FIG. 1 is a perspective exploded view of an assembled dumbbell assembly according to the invention without plates in the receptacles.
Figure 2:
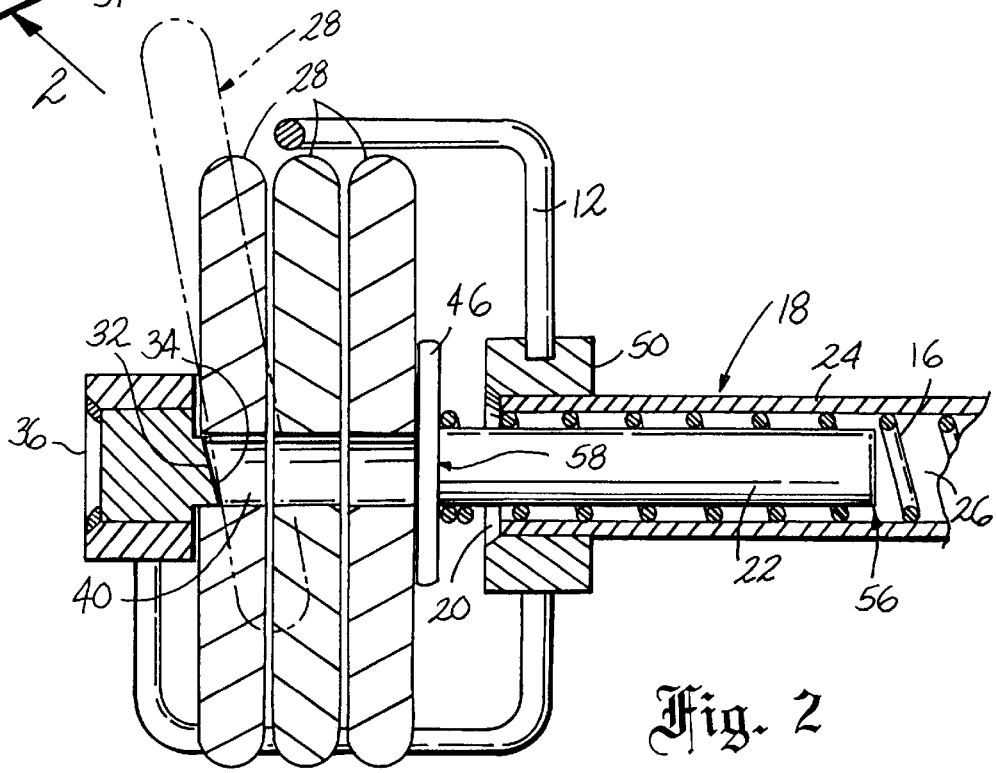
FIG. 2 is a cross-sectional view of one end of an assembled dumbbell assembly shown in FIG. 1 with plates in the receptacle including phantom lines showing a plate being inserted into the receptacle.

Referring now to FIGS. 1 and 2, a dumbbell assembly 10 is shown having a pair of receptacles 12 and 14, which are containers adapted to receive and secure the weighted plates 28, integrally molded or rigidly secured to opposite ends of a handle bar 18. The plates 28 can be any conventional weighted disc which is mountable on a bar in a conventional dumbbell assembly (not shown) or any other weighted disc-shaped object which may be received by the receptacles 12 and 14.

In a first embodiment, the handle bar 18 includes a tube 24 defining an elongated opening 26. The tube 24, which has two ends, houses a spring 16 and shafts 22. Only one end of the dumbbell assembly will be described with the understanding that the same description applies to the other end. As illustrated in FIG. 2, the shaft 22 is surrounded by the spring 16 and has a free end 56 and a second end 58. The free end 56 terminates in the tube 24 and the second end 58 extends out of a tube end 20 and into the receptacle 12 where it is attached to a push platter 46. The push platter 46 is biased away from an inner end 50 and toward an outer end 36 of the receptacle 12 by the spring 16 and is retained within the receptacle 12 by the outer end 36.

The receptacle 12 is a cage formed of wires bent and welded together and having an aperture 44 adapted to receive the weighted plates 28, as best shown in phantom lines in FIG. 2. As shown in FIG. 1, each cage of the receptacle 12 is partially defined by a pair of U-shaped legs 37 depending downwardly from the outer end 36 and the inner end 50 and having a mid portion 35. An open space 51 is formed between parallel mid portions 35 of the legs 37. As shown in phantom, the weighted plates 28 are partially received within the open space 51 between the adjacent mid portions 35 of the legs 37. Alternatively, the receptacle 12 can be made of sheet material (not shown) rather than wire for containing the weighted plates 28, and can include a similar aperture adapted to receive the weighted plates 28. The receptacle 12 includes a latching or locking mechanism to prevent the plates 28 from unintentionally passing through the aperture 44. While other means of securing the plates are possible, a wedge-shaped tab 32 extending into the receptacle 12 from an outer end 36 of the receptacle 12 is shown. A ramp 34 of the tab 32 slopes toward the aperture 44 so that the plates 28 slide along the ramp 34 as they are pushed into the receptacle 12, as illustrated in phantom lines in FIG. 2.

To assemble the dumbbell 10, inner ends 50 and 52 of each of the receptacles 12 and 14, respectively, are attached to their respective ends of the tube 24. The spring 16 is inserted in the tube 24 and the shafts 22 are placed inside the spring 16 so that a portion of each of the shafts 22 and the spring 16 extend beyond each end 20 of the tube 24. The push platters 46 and 48 are attached to their respective shafts 22, thereby securing the spring 16 between the push platters 46 and 48, around the shafts 22, and substantially inside and through the tube 24.

In operation, the plate 28, as seen in phantom lines in FIG. 2, is inserted into the receptacle 12 through the aperture 44 by pushing the plate 28 against the spring 16 biased push platter 46. Once fully inserted, the outer-most plate 28 is pushed against the outer end 36 of the receptacle 12 by the spring biased push platter 46. To prevent the outer-most plate 28 from falling out of the receptacle 12 through the aperture 44 during use, the tab 32 is received in the plate opening 40 in the plate 28. To remove the plate 28, the user must release the tab 32 from the plate opening 40 by pushing the plate 28 against the spring biased push platter 46. Once the plate opening 40 of the plate 28 clears the tab 32, the plate 28 can be slid along the ramp 34 and removed through the aperture 44 of the receptacle 12.

Figure 3:
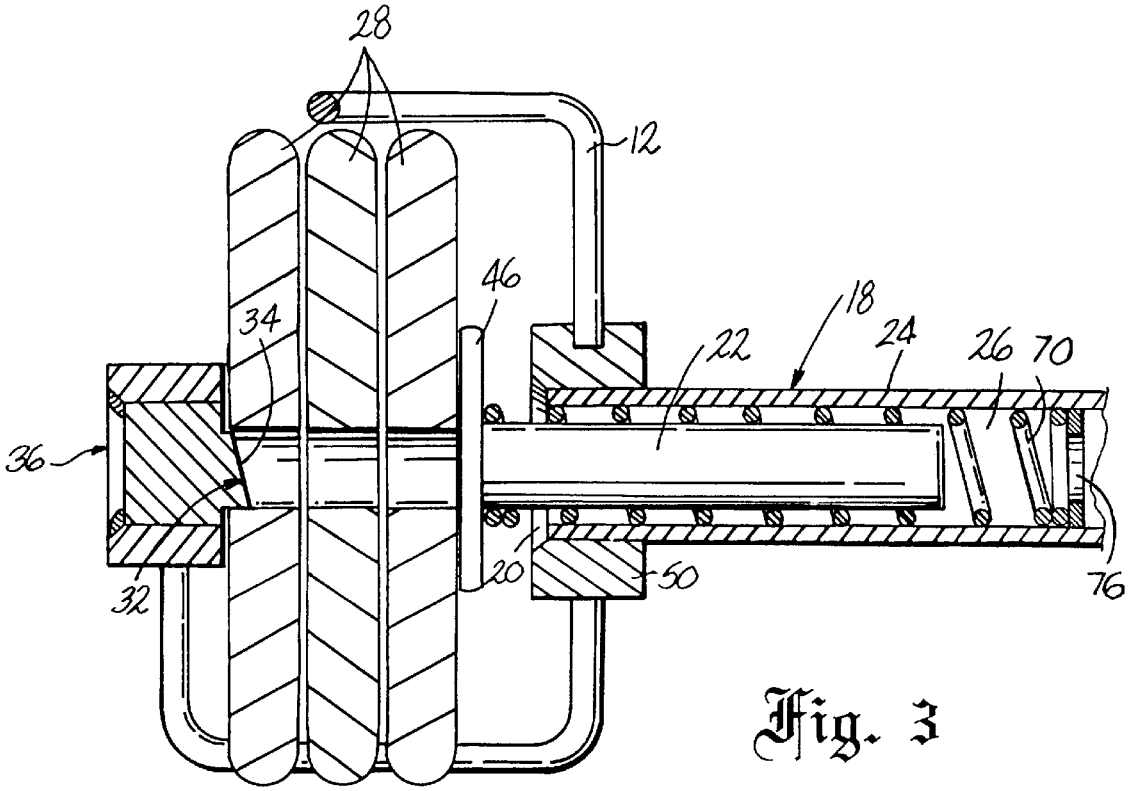
FIG. 3 is a cross-sectional view of one end of an assembled dumbbell assembly according to a second embodiment of the invention with plates in the receptacle.

As shown in part in FIG. 3, an additional embodiment is similar to the prior embodiment but includes a spring 70 striking an abutment 76 inside the tube 24, thereby biasing the spring 70 away from the abutment 76 and toward the outer end 36 in the same manner as described for the first embodiment. The assembly is the same as the assembly of the first embodiment except that the spring 70 is inserted into an end of the tube 24 until the spring 70 reaches the abutment 76. The same description applies to the other end of the dumbbell assembly 10 (not shown). Operation of this embodiment of the dumbbell assembly 10 is the same as described for the first embodiment.

It should be understood that the aforementioned embodiments can be further altered by enclosing a spring or multiple springs within a guide or other housing offset from a handle bar and between a pair of receptacles such that the handle bar may or may not include a spring for biasing push plates and the offset guide or guides do include at least one spring for biasing the push plates within the receptacles.

Figure 4:
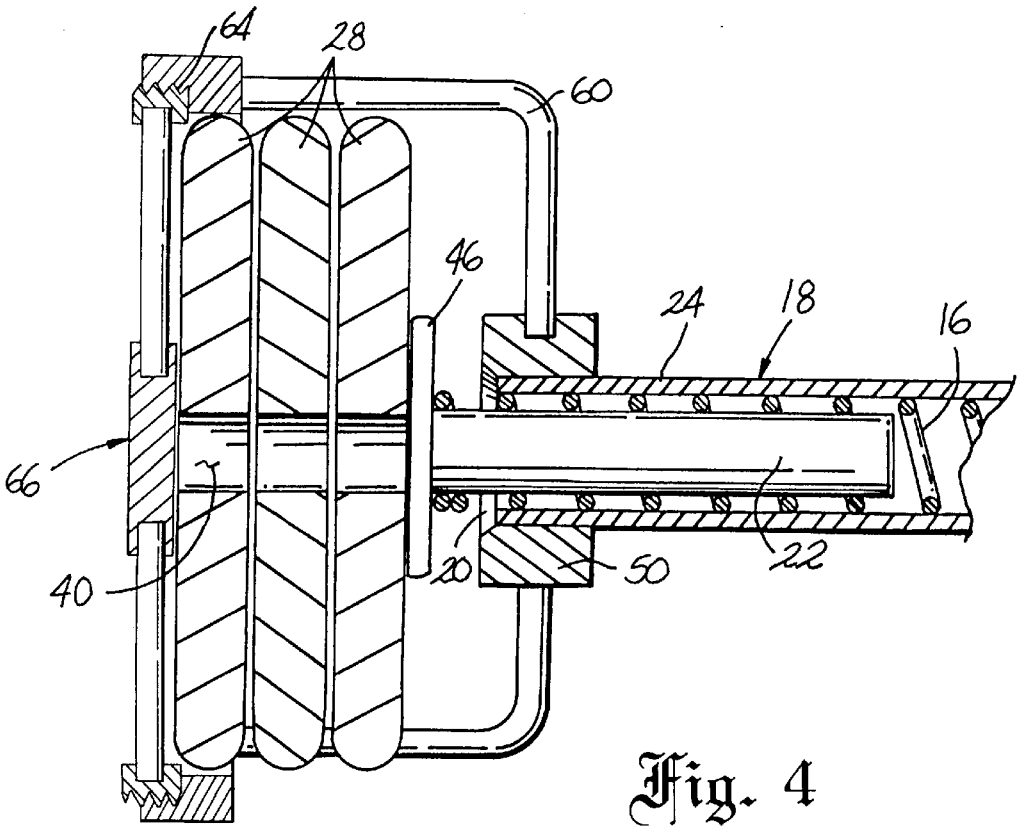
FIG. 4 is a cross-sectional view of one end of an assembled dumbbell assembly according to the third embodiment of the invention with plates in the receptacle.

Another embodiment, as shown in part in FIG. 4, includes a handle bar 18, which is integrally molded or rigidly secured to a receptacle 60. Only one end of the dumbbell assembly is shown and described with the understanding that the same description applies to the other end. The receptacle 60 is a container having a removable cap 80 at an outer end 64 for facilitating loading, securing, and unloading of the weighted plates 28. The receptacle 60 houses the shaft 22, which is substantially surrounded by the spring 16 and attached to the push platter 46 in the receptacle 60. The receptacle 60 includes an opening 66, including a threaded socket 68, which receives the weighted plates 28 when the cap 80 is removed. After the plates 28 are inserted, the cap 80 is threaded into the opening 66, thereby securing the plates 28 between the push platter 46 and the cap 80.

Alternatively, the threaded socket 68 could be replaced by a conventional bayonet fitting such that a bayonet-fitted cap is pushed gently and then turned to lock the cap in place. A bayonet-fitted cap has a spring which holds a finger on the cap in the correct place in the L-shaped slot of the conventional bayonet fitting.

This embodiment of the dumbbell assembly is assembled in the same manner as described for the first embodiment with the exception that the cap 80 is threaded into the receptacle 60 so that the plates are forced against the cap 80 by the push platter 46. To use the dumbbell assembly, the plates 28 are inserted into the opening 66 that exists when the cap 80 is removed from each outer end 64 of the receptacle 60. The cap 80 is then threaded into the receptacle 60, thereby securing the plates 28 between the cap 80 and the push platter 46 and against the bias of spring 16 inside the receptacle 60.

Figure 5:
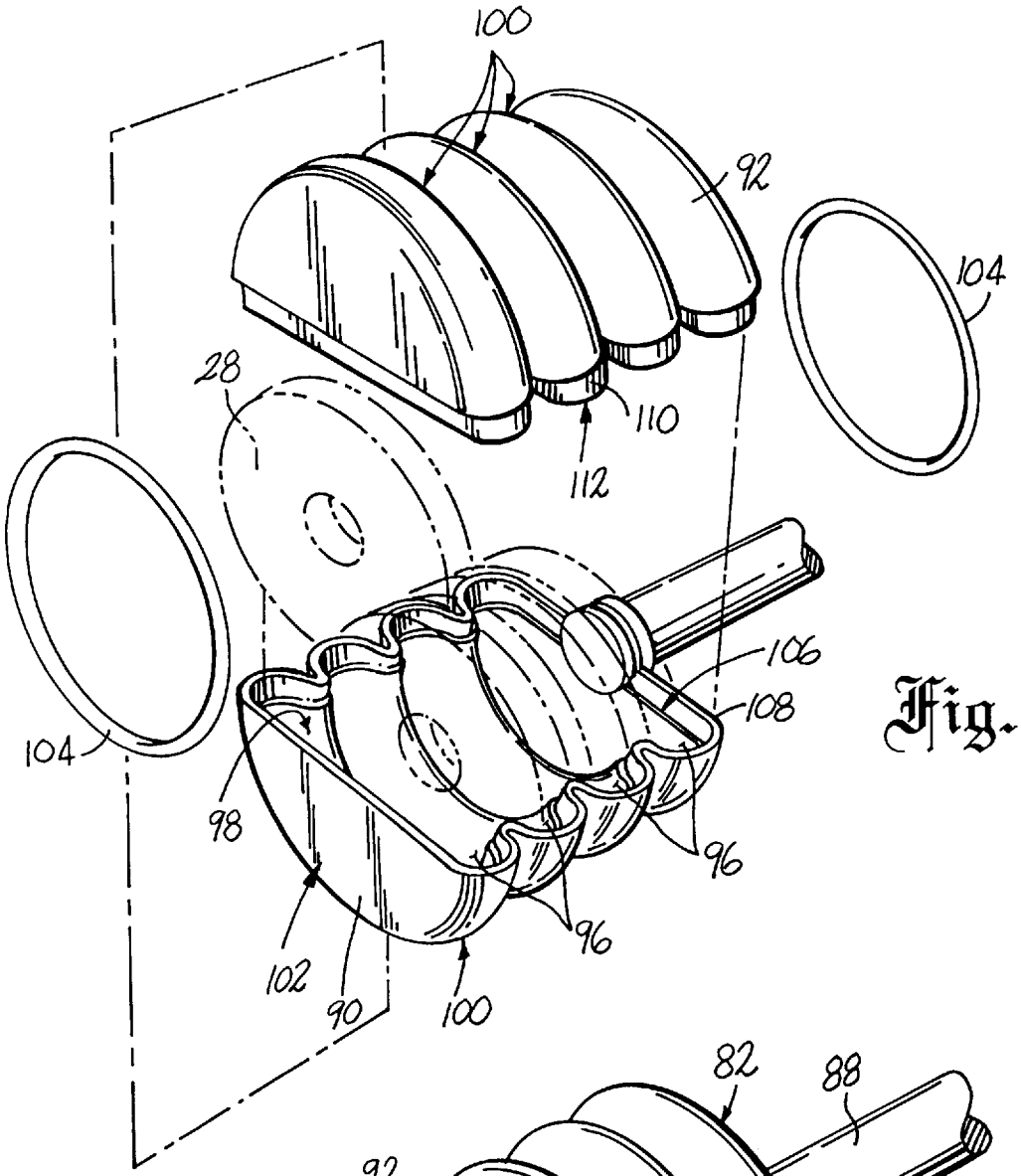
FIG. 5 is an exploded perspective view of one end of an assembled dumbbell assembly according to a fourth embodiment of the invention with plates in the receptacle shown in phantom lines.
Figure 6:
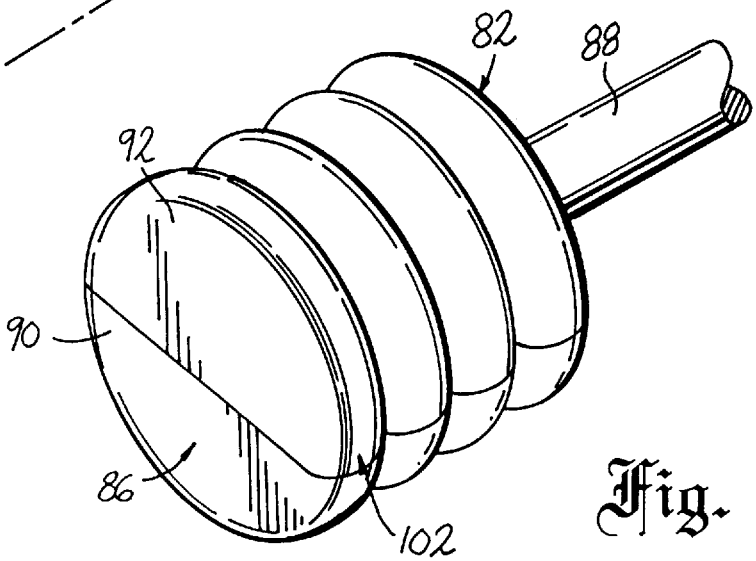
FIG. 6 is a perspective view of one end of an assembled dumbbell assembly according to the fourth embodiment of the invention.

A fourth embodiment, shown in part in FIGS. 5 and 6, includes a handle bar 88 integrally molded or rigidly secured to a receptacle 82, which is a grooved solid shell with mated first and second portions 90 and 92. Only one end of the dumbbell assembly is shown and described with the understanding that the same description applies to the other end. The first and second portions 90 and 92 are separable for receiving the weighted plates 28, and mated, with the first portion 90 including a groove 106 and a lip 108 for receiving a lip 110 and groove 112 of the second portion 92, respectively. Both the first and second portions 90 and 92 of the receptacle 82 include a series of grooves 100 on an outer wall 102 for seating an elastomeric ring-shaped band 104. An inner wall 98 of both the first and second portions 90 and 92 include a series of alternating spaces 96 and ribs 99 adapted to retain and receive at least a portion of the plates 28, as shown in phantom lines in FIG. 5. The mated portions 90 and 92 of the receptacle 82 are secured when the elastomeric ring-shaped band 104 is seated in one of the grooves 100 in the outer wall 102 of the receptacle 82.

During assembly, the first portion 90 of the receptacle 82 is rigidly secured or integrally molded to the handle bar 88 with the lip 110 and the groove 112 of the second portion 92 matingly received by the groove 106 and lip 108 of the first portion 90, respectively. The second portion 92 is secured to the first portion 90 by at least band 104 fitted around the mated portions and seated in one of the grooves 100.

During operation, the O-ring 104 is removed from the receptacle 82 and the first portion 90 is removed from the second portion 92, either completely or hingedly (not shown), thereby defining an opening in the receptacle 82 for receiving the plates 28. The plates 28 are placed into the spaces 96 between the ribs 99 on the inner wall 98 of the receptacle 82. Once all the desired plates 28 are appropriately placed in the spaces in the first portion 90 of the receptacle 82, the lip 110 and the groove 112 of the second portion 92 are matingly received by the groove 106 and lip 108 of the first portion 90, respectively, so as to enclose and contain the inserted plates 28. Finally, the band 104 is forced over the outer end 86 and into one of the grooves 100 of the receptacle 82 to secure the mated portions 90 and 92 to each other and the plate 28 within the mated portions.

The invention applies equally well to a barbell assembly, which typically differs from a dumbbell assembly only by the length of the handle and the number of weighted plates that the handle accommodates.

Reasonable variation and modification are possible within the spirit of the foregoing specification and drawings without departing from the scope of the invention.

The embodiments of the invention in which an exclusive property or privilege is claimed are defined as follows:

1. A weight lifting device comprising:

one or more disc-shaped weights;

a handle having ends;

receptacles mounted to the ends of the handle and adapted to receive the one or more disc-shaped weights, the receptacles each comprising an inner end attached to one of the ends of the handle, an outer end distal the handle and a sidewall connecting the inner and outer ends;

the receptacles each including an aperture formed in the sidewall thereof and sized to admit the one or more disc-shaped weights into the receptacle therethrough;

a guide mounted to each receptacle and mounting a compression spring; and the compression spring for biasing the one or more weights into an end of each of the receptacles.

2. A weight-lifting device according to claim 1 wherein the receptacles are formed as a wire cage with an opening for receiving the one or more weights.

3. A weight-lifting device according to claim 2 wherein the handle is hollow and forms the guide.

4. A weight-lifting device according to claim 3 and further comprising a pressure plate mounted in each receptacle, in abutting relationship to the spring and adapted to abut one of the weights in a respective receptacle.

5. A weight-lifting device according to claim 4 and further comprising a shaft mounted within an end of the spring and connected to one of the pressure plates to support the one pressure plate.

6. A weight-lifting device according to claim 4 and further comprising a shaft connected to each pressure plate and mounted in an end of the spring.

7. A weight-lifting device according to claim 6 wherein there are two springs, one mounted in each end of the handle to bias the weights into the ends of the receptacles.

8. A weight-lifting device according to claim 6 wherein there is one spring which extends between each of the receptacles.

9. A weight-lifting device according to claim 4 and further comprising a positioning tab mounted centrally in an end of each of the receptacles distal from the handle for releasably retaining a disc-shaped weight with a central aperture against the pressure from the spring.

10. A weight-lifting device according to claim 9 wherein the positioning tab has a ramped outer surface to guide the one or more weights into each of the receptacles.

11. A weight-lifting device according to claim 9 wherein the receptacle opening is at an outer end of each of the receptacles in register with the positioning tab.

12. A weight-lifting device according to claim 2 further comprising a positioning tab mounted centrally in an end of each of the receptacles distal from the handle for releasably retaining a disc-shaped weight with a central aperture against the pressure from the spring.

13. A weight-lifting device according to claim 12 wherein the positioning tab has a ramped outer surface to guide the one or more weights into each of the receptacles.

14. A weight-lifting device according to claim 1 further comprising a positioning tab mounted centrally in an end of each of the receptacles distal from the handle for releasably retaining a disc-shaped weight with a central aperture against the pressure from the spring.

15. A weight-lifting device according to claim 14 wherein the positioning tab has a ramped outer surface to guide the one or more weights into each of the receptacles.

16. A weight-lifting device according to claim 1 wherein the handle is hollow and forms the guide.

17. A weight-lifting device according to claim 1 and further comprising a pressure plate mounted in each receptacle and in abutting relationship to the spring and adapted to abut one of the weights in a respective receptacle.

* * * * *